United States Patent [19]

Malavasi

[11] 4,135,338

[45] Jan. 23, 1979

[54] MODULAR ELEMENTS FOR COVERING FLOORS AND WALLS WITH TILES AND THE LIKE

[76] Inventor: Alberto Malavasi, Piazza Citta Leonia, 9, Rome, Italy

[21] Appl. No.: 789,207

[22] Filed: Apr. 20, 1977

[51] Int. Cl.[2] ..... E04C 5/18; E04F 13/08

[52] U.S. Cl. ..... 52/387; 52/389

[58] Field of Search ..... 428/542; 52/387, 391, 52/386, 509, 388, 318, 389, 385, 384, 390

[56] References Cited

U.S. PATENT DOCUMENTS

| | | | |
|---|---|---|---|
| 903,183 | 11/1908 | Eggers | 52/387 |
| 2,223,721 | 12/1940 | Ernstoff | 52/391 |
| 2,337,180 | 12/1943 | Burden-Cooper | 52/509 |
| 3,520,095 | 7/1970 | Jonason et al. | 52/387 |
| 3,533,206 | 10/1970 | Passeno | 52/391 |
| 4,011,702 | 3/1977 | Matyas | 52/387 |

*Primary Examiner*—John E. Murtagh

*Attorney, Agent, or Firm*—J. Harold Nissen

[57] ABSTRACT

Preformed modular element for forming floor and wall coverings in combination with tiles and the like. The assembled modular elements define an array of regular-assembled modular elements define an array of regularly shaped cavities, each adapted to receive at least one the tile thickness, thus resulting in an array of grooves between adjacent tiles, corresponding to the modular elements that separate the tiles and are depressed of the top faces thereof; finishing strips being received in the grooves of such a thickness to be flush with the tile top faces.

10 Claims, 10 Drawing Figures

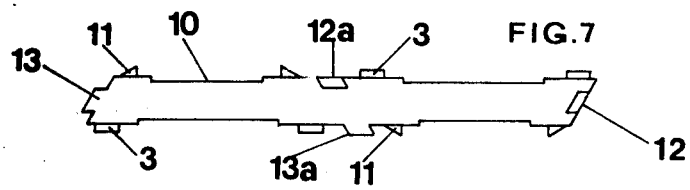
FIG.7
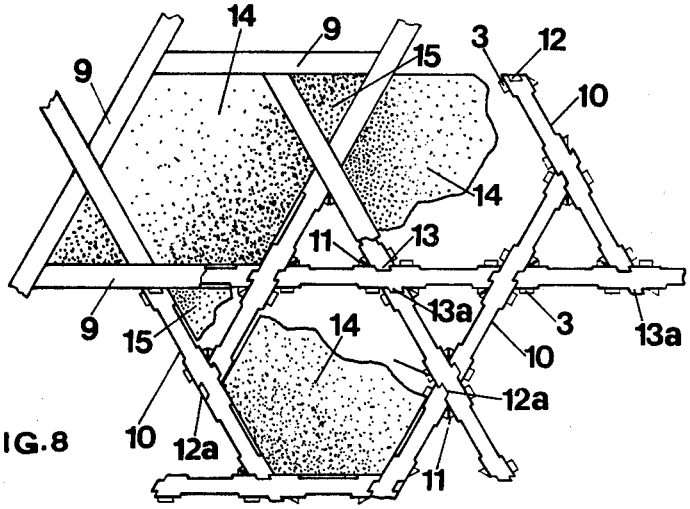
FIG.8
FIG.9
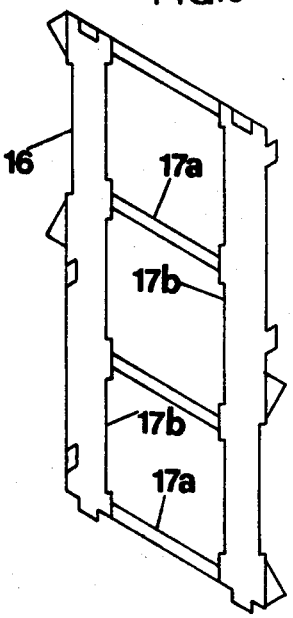
FIG.10
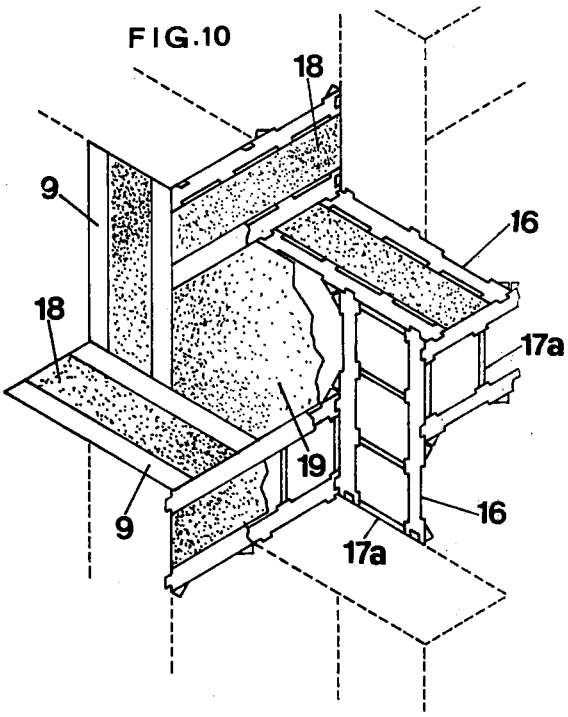

MODULAR ELEMENTS FOR COVERING FLOORS AND WALLS WITH TILES AND THE LIKE

This invention relates to a prefabricated modular element for forming a reticular support to define cavities for receiving tiles and the like. The tiles are inserted in the reticular support in a spaced-apart relationship, and create tile connecting bands, which bands can afterwards be covered, as they will be preferably covered with strips or the like of a suitable material, fixed to the modular elements by means of suitable adhesives.

The modular elements, in a depressed position in respect to the top faces, are provided with transversally projecting tabs or brackets of any shape and/or size, supporting at least a portion of at least one of the sides of the adjacent tiles, while to allow two modular elements to be connected in aligned or angular relationship, the elements are provided with fixed joints or other suitable joints for the connection of the modular elements.

This invention also relates to floor or wall coverings formed with a series of the elements above set forth, comprising non-conventional modular elements and conventional tiles and possible covering strips thereof. This type of floor or wall covering has the peculiarity of employing tiles and the like, of any possible shape, and preferably polygonal, square, rhomboidal and with curved or mixed profiles, and made of any suitable material and particularly of ceramic, stoneware, glass, tile, plastics, marble or other natural stones, as well as synthetic materials and the like. Each tile has its own housing cavity defined by a reticular support composed of the prefabricated modular elements, forming connecting bands which separate a tile from the adjacent tiles. The tiles, or the like, are secured on the reticular support by means of a small quantity of cement conglomerate or other suitable adhesive, placed in the cavity for fixing each tile in its cavity in a substantially independent relationship. The adhesive is also used to fix said reticular structure to the wall or floor structure by means of said tiles and said tabs. The reticular support, formed by the modular elements, is preferably covered with strips, which can be of a minimum thickness or be made of non-rigid materials, as the stiffening effect caused by the underlying support, to which the strips will be fixed by means of a suitable adhesive, contributes to strengthen the strips.

The strips will be made of wood, plastic covered or otherwise treated wood, cork, plastics, or synthetic materials, metal, rubber or stripes of a soft material such as the so-called "moquette" or, more generally, the strips will be made of any suitable material, whereby a combined floor is obtained, which comprises strips and tiles of any suitable material.

Combined floors made of different materials are already known, but these floors were obtained with a mosaic composition, whereby the cooperating elements were simultaneously placed in a side-by-side relationship in a casting of cement. With this previous system of forming combined floors, the floors became lumpy, owing to the uneven unit load the elements were able to bear; the strips were rigid and, where made of wood, they easily embarked; they were difficult to repair and maintain and required the use of skilled and costly work owing to the very difficult laying thereof.

On the contrary, a floor or wall covering according to this invention, has the important advantage of allowing any broken tile to be easily and quickly replaced without damaging the adjacent tiles.

Moreover forming the reticular support with prefabricated modular elements, including elements for the mutual connection thereof, makes it easy forming of the tile housing cavity even to a completely inexperienced person. Placing the tiles in the so-formed housing cavities automatically allows the tiles to be perfectly aligned. The modular elements, function as a ledge and a rule or a straight edge, and assure that the tiles all lie in the same plane. The modular elements are of lightweight structure, easy to handle and cheap to manufacture as they can be moulded in their final shape from a suitable plastic material.

The appended drawing show, for illustrative and not restrictive purposes, some possible embodiments of the invention, and precisely:

FIG. 7 shows the front face of another type of modular element forming a supporting reticular structure receiving two different types of tiles.

FIG. 8 shows, with fragmentary sections, a view of a floor formed making use of the modular element of FIG. 7.

FIG. 9 shows the front face of an element similar to the element of FIG. 7, but of such a width as to form the housing cavity for a tile.

FIG. 10 shows a portion of floor covering, in different steps of the forming operation thereof, performed making use of the modular element of FIG. 9.

Figure 1:
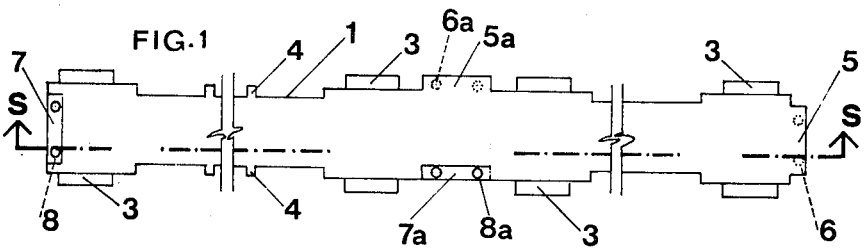
FIGS. 1 and 2 are, respectively, a top and a bottom view of a first embodiment of a bar-shaped modular element.

In the embodiment of FIGS. 1 to 4 the modular element generally indicated with reference 1 comprises a bar shaped element, made of a plastic material and moulded in its final shape. Of course, it is possible to obtain modular elements by a moulding or melting process, and in different but functionally equivalent shapes, and/or making use of different materials, such as rolled sections. Element 1, in the illustrated embodiment, is of a length which is two times the width of a tile, plus the selected width of element 1. The tile and the like is generally indicated by reference 2, and in this embodiment it is square shaped. It has to be pointed out, however, that two or more separate rectangular tiles, in abutting relationship, can also be used to replace a square tile 2 and, in this instance, the number of support tabs, which will be described below, will be suitably increased.

In this instance the modular elements 1 are formed to support two sides of two tiles on each longitudinal side and accordingly at least a pair of brackets or tabs 3 for each tile 2 are protruding along the longitudinal sides of each element 1, these tabs having their lower face flush with the lower face of the bar shaped element 1. Furthermore, the thickness of tabs 3 allows the upper face thereof to remain below the upper plane of element 1 with a distance less than, or possibly equal to, the thickness of the tiles 2 utilized herein.

It can be observed that preferably tile 2 will rise above the plane formed by modular elements 1 by a length equal to the thickness of a strip to be described below, which will be used as a cover for elements 1. There are two tabs 3 for each side of tiles 2 but, more generally, the tabs will be provided in a number sufficient to support one side of the tile in cooperation with the tabs 3 of the other elements 1, defining the housing cavity for a tile 2. One end of each modular element 1 is provided with a tongue 5, aligned with the upper face of element 1, having at least a tooth 6 downwardly protruding from the lower face thereof. A notch 7 is cut at the other end of each modular element 1, which is complementary to the tongue 5 in order to receive the latter and to obtain again the thickness of modular elements 1, in this connection area, while a hole 8 is drilled in the bottom of notch 7 for receiving each tooth 6 and completing the fixed-joint connection of two modular elements 1 placed in angular relationship therebetween.

Figure 2:
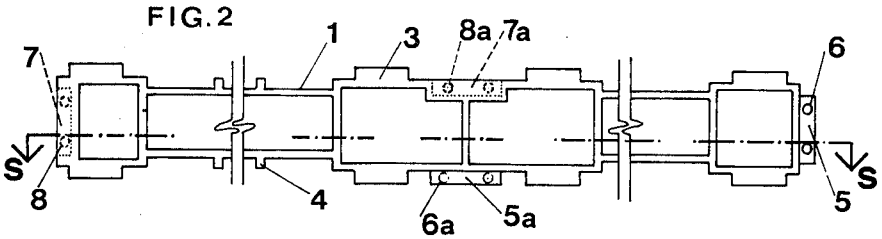

In correspondence with the transverse symmetrical plane of each modular element, the element 1 is provided with a tongue 5*a* and teeth 6*a* on one side, and a notch 7*a* and holes 8*a* in the other side, having the same function of those provided on the end joints of modular element 1 and intended to allow a right-angle connection of two modular elements 1, identical with the connection shown in FIGS. 1 and 2. Of course, any other functionally equivalent system of connection may be substituted to the one illustrated therein.

Figure 3:
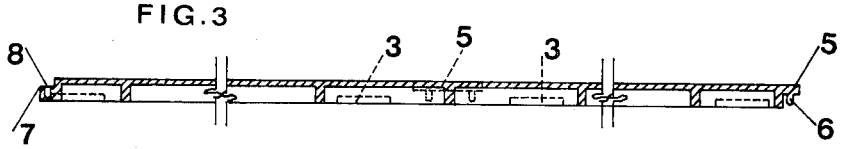
FIG. 3 is a fragmentary longitudinal sectional view taken along line S—S in FIGS. 1 and 2.
Figure 4:
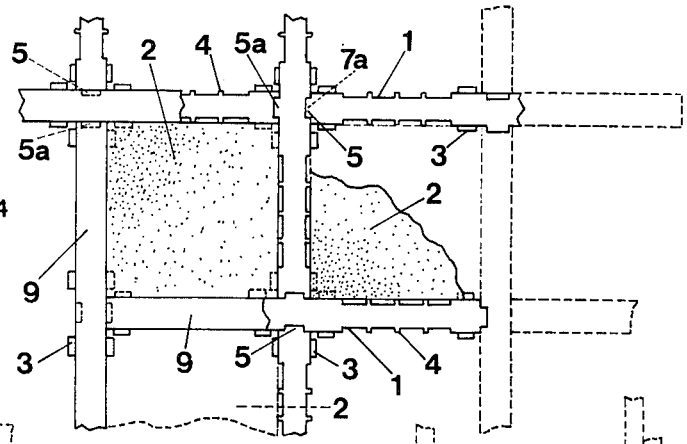
FIG. 4 is a plan view of a portion of a floor- or wall-covering formed utilizing the bar shaped modular element of FIGS. 1 to 3, with fragmentary sections of some elements thereof, and in different steps of the forming operation.

With reference to FIG. 4 therein, the assembling method is now shown for laying a floor or wall covering employing modular elements of the type shown in FIGS. 1 to 3. On the floor or wall to be covered, the modular elements are arranged to form a reticular support, placing longitudinal and transverse rows of elements 1, cutting off, where required, the excessive portions to accomodate the reticular structure to the shape and size of the wall or floor. After laying of the reticular support, modular elements 1 will define a plurality of housing cavities, which will be square-shaped in this case, each cavity being adapted to receive a tile 2. Before laying each tile 2, a small quantity of mortar or other adhesive will be placed in the cavity. A slight knock on the tile 2 will cause the same to compress the utilized adhesive for securing the tile to the floor or wall until tile 2 is engaged with the upper face of the supporting tabs 3. Any excessive material will come out from the splits or spaces formed between guiding teeth 4. After setting, tile 2 will be secured to the underlying floor or to the wall behind and, by means of tabs 3, will also fix the reticular support formed by modular elements 1.

Tabs 3 will operate also as a ledge and rule preventing a generic tile to be in a depressed or raised position in respect of the place of the other tiles.

After setting, modular elements 1 are preferably covered with strips 9 secured by means of adhesives. Depending on the desired decorative effects, the strips, as already stated, will be made of various suitable materials. Of course, should the strips 9 be employed, the thickness of elements 1 will be sized to allow tiles 2 to project from the upper face of elements 1, of such a length as to have their facing plane flush with the plane formed by strips 9 or the like utilized therein.

Figure 5:
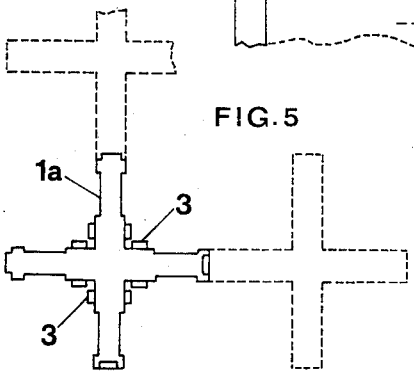
FIGS. 5 and 6 show a cross shaped modular element and a square modular element, respectively, both elements being intended to form a reticular structure similar to the reticular structure illustrated in FIG. 4.
Figure 6:
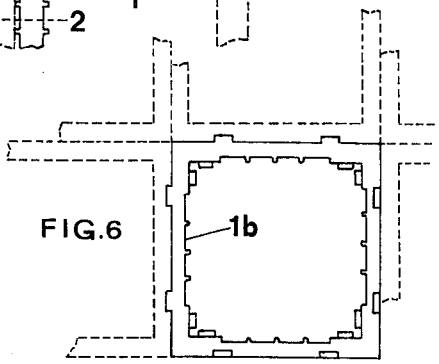

It has also to be pointed out that the same reticular support and, accordingly, the same embodiment of FIG. 4 will be obtained as well making use of the same tiles 2 and the same strips 9 but replacing the bar shaped element 1 by another modular element, such as the star element 1*a* of FIG. 5 or the square element 1*b* of FIG. 6 or, more generally, any other modular element which, once assembled with similar elements, will form a reticular support corresponding to the reticular support of FIG. 4.

It has also to be pointed out that in the embodiments described below, which are intended to be illustrative and not restrictive of the invention, the reticular support will be obtained both with the already illustrated modular elements and with one or more modular elements complementary to said reticular support, being stated that, even modifying the structure of the modular elements, forming the reticular support, its function remains unchanged.

The embodiment of FIGS. 7 and 8 is substantially identical with the above embodiment. Modular elements 10 are here again bar shaped elements, comprising support tabs 3 and 11; however female joints 12 and 12*a* and male joints 13 and 13*a* are provided for connecting modular elements 10 under 30° angles. This system is assembled in the same way as above, but this different coupling system will provide housing cavities for two different types of tiles and precisely for conventional hexagonal tiles 14 and triangular tiles 15, whereas the strips 9 will be of rhomboidal configuration.

The embodiment of FIGS. 9 and 10 is a modification of the embodiment of FIGS. 7 and 8. In this case the bar shaped elements 16 are very wide so that, by means of the depressed transverse memebers 17*a*, which connect two beam shaped side elements 17*b* and also replacing the tabs, at least a housing cavity for a tile 18 can be formed in the body of each modular element 16. In this case, the floor will be covered with hexagonal tiles 19 and rhomboidal tiles 18 and with strips 9 (FIG. 10); the junction area will be provided with pairs of mutually engaging elements. Of course, according to the same concept, other types of modular elements can be obtained, which are complementary and able to be mutually connected by means of fixed joints and like, and defining, in combination, housing cavities for a plurality of tiles.

I claim:

1. A prefabricated modular element for forming a surface covering for a base such as a wall or a floor surface, in which the surface covering includes tiles which can be made from different component materials and the outer facing surface is free from lumps and unevenness, comprising:

a plurality of rigid bar shaped elements each including connection means at their opposite ends and at the midpoint thereof between said opposite ends for connection of individual of said elements together to form a reticular support adapted for placement onto said base;

each of said bar shaped elements including a lower facing surface and an upper facing surface having a preselected spacing therebetween;

a plurality of supporting ledges connected with said lower facing surface of each said bar shaped elements, each said ledges being in the form of projecting tabs having a lower surface flush with the lower surface of said bar shaped elements, the thickness of said tabs being less than said preselected spacing so that the upper surface of said tab is below the upper surface of said bar shaped elements;

said preselected spacing being at least equal to the thickness of said tiles whereby said tiles are supported by said tabs in said reticular support spaced from said base, the spacing between said base and the bottom surface of said tiles being at least equal to the thickness of said tabs;

said rigid bar shaped elements being interconnected by said connection means to form with said base a cavity to receive said tiles;

adhesive material placed into and onto said base, said cavity and the bottom surface of said tiles being pressed against said adhesive material to form a firm bond with said adhesive material, said bottom surface of said tiles solely holding said tabs to said base for connection thereto of said reticular support together with said tiles.

2. The modular element as claimed in claim 1, including auxiliary strips covering said top surfaces of said rigid bar shaped elements.

3. The modular element as claimed in claim 2, wherein the thickness of said tiles plus the thickness of said tabs is greater than the thickness of said rigid elements, so that the top surface of said tiles project above said top surface of said rigid elements, and the thickness of said auxiliary strips is selected in accordance with the thickness of said tiles to provide a uniformly continuous outer surface covering without defined transitional lines between said auxiliary strips and said tiles, whereby said tiles and strips are flush and in a uniform plane as said rigid bar shaped elements take up any unevenness in said base.

4. The modular element as claimed in claim 2, wherein said auxiliary strips are formed of non-rigid material, and adhesive means to afix said auxiliary strips to said bar elements.

5. The modular elements are claimed in claim 1, including guiding teeth between said ledges on each said bar elements, and said teeth having spaces therebetween communicating with said cavity to permit excessive adhesive to be guided out of said cavity from between the bottom of said tile and said base, thereby preventing bulging of said tiles, whereby to provide a uniform surface covering with said rigid bar elements taking up any unevenness in said base.

6. The modular element as claimed in claim 1, wherein each said bar element includes a straight flat surface between said upper and said lower surfaces to provide a straight edge for a side of said tile, said straight flat surface having a plurality of inwardly directed spaces separated by projecting teeth connected with said bar element, said projecting teeth extending to said straight flat surface and positioned between said ledges, said spaces permitting excessive adhesive to exist from said cavity to the front surface of the tile while assuring uniform distribution of said adhesive between said base and the bottom of said tile without causing an outward bulging thereof.

7. The modular element as claimed in claim 1, wherein each of said bar elements has a length equal to twice the width of said tiles and a width equal to the width of said covering strip.

8. The modular element is claimed in claim 1, wherein each of said bar elements includes at least two ledges for each tile in support engagement thereiwth, each said tile having one of its sides in said support engagement with one of said bar elements, and each of said bar elements being in support engagement with at least two tiles.

9. The modular element as claimed in claim 1, wherein:

said connecting means including angularly related complementary connectors at said opposite ends and said midpoint for connecting said rigid bar shaped elements together to form a tile housing network for said tiles with angles between adjacent connected elements being equal to angles opposite thereto between opposite adjacent connected elements, and said tiles having an outer configuration to fit within said housing network.

10. The modular element as claimed in claim 1, wherein said connecting means includes a first tongue-notch arrangement with said tongue aligned with said upper surface of said bar element at one end thereof and at the midpoint thereof on one side thereof, and a second tongue-notch arrangement with said last-mentioned tongue being aligned with said lower surface of said bar element at said other end thereof and at said midpoint thereof on said other side thereof, said first and said second tongue-notch arrangements being adapted for engagement with each other to provide for uniform continuous surfaces of said upper and said lower surfaces of said bar elements, said first tongue-notch arrangement being provided with hole therein, and said second tongue-notch arrangement including a projecting tooth for engagement with said hole to lock said first and said second tongue-notch arrangement together, said connecting means are angular arranged with said bar elements to form said reticular support with two different types of cavities, and tiles complementary to the outer configuration of said cavity to provide a tile surface covering with different tile configurations.

* * * * *